US005724681A

United States Patent [19]

Sykes

[11] Patent Number: 5,724,681

[45] Date of Patent: Mar. 10, 1998

[54] SHOCK-ABSORBING HELMET COVER

[76] Inventor: Bob Sykes, 1816 E Oakland Park Blvd, Apartment 65, Oakland Park, Fla. 33306

[21] Appl. No.: 755,170

[22] Filed: Nov. 22, 1996

[51] Int. Cl.[6] ..... A42B 3/00

[52] U.S. Cl. ..... 2/425; 2/422; 2/411

[58] Field of Search ..... 2/410, 411, 412, 2/422, 425

[56] References Cited

U.S. PATENT DOCUMENTS

| | | | |
|---|---|---|---|
| 3,174,155 | 3/1965 | Pitman | 2/411 |
| 3,242,500 | 3/1966 | Derr | 2/412 |
| 3,263,235 | 8/1966 | Young | 2/422 |
| 3,435,460 | 4/1969 | Grant | 2/422 |
| 3,445,860 | 5/1969 | Rodell | 2/422 |
| 3,818,508 | 6/1974 | Lammers et al. | 2/412 |
| 4,599,752 | 7/1986 | Mitchell | 2/425 |
| 4,937,888 | 7/1990 | Straus | 2/411 |

*Primary Examiner*—Michael A. Neas
*Attorney, Agent, or Firm*—Frank L. Kubler

[57] ABSTRACT

A protective cover apparatus for a helmet including a helmet shell with a helmet outer surface and a face exposing opening bordered by a helmet male snap fastener half protruding from the helmet outer surface, a helmet anchoring chin strap assembly having a strap extending from the strap assembly, the strap having a strap female snap fastener half which engages the helmet male snap fastener half bordering the face exposing opening includes a shock-absorbing layer having a layer inner surface and a layer outer surface and which extends over the helmet outer surface and over the helmet male snap fastener half; a shock-absorbing layer attachment assembly including an attachment mechanism including a fastener interconnection structure passing through the layer at a location corresponding to and directly over the helmet male snap fastener half, the interconnection structure having a structure inside end to which is affixed a cover female snap fastener half for removably engaging the corresponding helmet male snap fastener half, and the interconnection structure having a structure outside end to which is affixed a cover male snap fastener half to engagingly receive the strap female snap fastener half so that the chin strap assembly may be attached with the cover in place over the helmet.

17 Claims, 3 Drawing Sheets

SHOCK-ABSORBING HELMET COVER

Filing History

The disclosure of this application is based on the content of disclosure document number 405,972 recorded in the Patent Office on Oct. 15, 1996.

BACKGROUND OF THE INVENTION

1. Field of the Invention

The present invention relates generally to the field of helmets and related accessories for protection when practicing hazardous activities, such as various sports, motorcycle riding and construction work. More specifically the present invention relates to a helmet cover including a form-fitting, shock-absorbing layer removably and replaceably secured with an inventive attachment assembly over the outer surface of a football helmet or similar helmet. The layer preferably extends over the entire helmet outer surface for full protection, specifically including the chin strap assembly fastener area and the dangerously protruding face cage hinge structure.

A conventional football helmet includes a face exposing opening shielded by a hinged face protection cage and bordered on either side by helmet male snap fastener halves. A helmet anchoring chin strap assembly is provided including a plastic cup which fits snugly over the wearer chin and two straps extending from each side of the cup. Each strap has a strap female snap fastener half at its helmet engaging end which engages one of the helmet male snap fastener halves bordering the face exposing opening.

The cover attachment assembly comprises four attachment mechanism, each including a fastener stem passing through the layer at each location corresponding to and directly over a helmet male snap fastener half. To each stem inside end is affixed a cover female snap fastener half for removably engaging the corresponding helmet male snap fastener half. To each stem outside end is affixed a cover male snap fastener half to engagingly receive one of the strap female snap fastener halves so that the chin strap assembly may be attached with the layer in place over the helmet. The cover male and female snap fastener halves are wider than the stem diameter, and thus together with the stem effectively define an attachment mechanism having a rivet configuration. The snap fastener at each stem end prevents each attachment mechanism from sliding out of the helmet cover.

To prevent forward and rearward movement of the layer relative to the helmet, a hook and loop cover fastener pad is affixed to the rear cover inner surface. The cover fastener pad engages a hook and loop helmet fastener pad affixed to the rear helmet outer surface.

The cover material is preferably a synthetic foam rubber. The preferred thickness is about three quarters of an inch, although many other thicknesses are contemplated and depend largely on the density and resilience of cover material used. The outside surface of the cover preferably displays a team logo and color scheme so that the covered helmet has an appearance substantially identical to a non-covered helmet.

2. Description of the Prior Art

There have previously been cover devices for helmets to help absorb impact and thus protect the wearer.

One such prior helmet cover is that of Straus, U.S. Pat. No. 4,937,888, issued on Jul. 3, 1990. Straus discloses a helmet cover including an elastomeric, cellular cover layer encased in a durable, flexible, resilient and integral skin with integral tabs molded to the cover layer. The tabs protrude from the skin edge and anchor the cover to the helmet. In the instance of a football helmet, two of the tabs are positioned to be inserted and hooked into helmet ear openings, and one tab is positioned to be inserted and fastened underneath the face cage hinge structure above the face exposing opening. A problem with the Straus design is that anchoring the cover with ear opening and cage hinge engaging tabs at the skin edge limits the cover from extending over and beyond the ear openings and over the hazardous protruding face cage hinge structure. The straus cover layer cannot extend over the chin strap assembly fasteners either because it would make them inaccessible. As a result, the maximized safety of complete helmet coverage cannot be achieved. The illustrated Straus cover extends over about one half of the helmet outer surface, leaving the wearer exposed to serious impact injury from all sides. Furthermore, the incomplete coverage distorts the appearance of the helmet. Another problem with Straus is that its inner cover layer and outer skin combined construction makes it relatively expensive. Another problem with Straus is that a screwdriver is needed to loosen and tighten face cage hinge structure screws to install and remove the helmet cover.

Mitchell, U.S. Pat. No. 4,599,752, issued on Jul. 15, 1986, teaches a protective cap for a sports helmet. Mitchell includes a helmet cover similar to that of Straus in that it engages the helmet ear openings. The Mitchell cover engages the ear openings with snap portions which are press fitted into the ear openings. These snap engagements prevent the cover from sliding from side to side on the helmet. To prevent the cover from sliding forward and backward on the helmet, vent holes are drilled through the helmet and cover layer anchoring plug portions protrude from the cover layer inner surface for fitting into these holes. A problem with Mitchell is that drilling the vent holes permanently alters and damages the helmet, so that it will leak if used in the rain without the cover. Another problem is that no provision is made for covering the hazardous protruding face cage hinge structure. Still another problem is that the cover cannot extend entirely over the lower helmet side surfaces because it would obstruct access to the chin strap fasteners, so that maximized safety and conformity to helmet appearance is not achieved.

It is thus an object of the present invention to provide a helmet cover apparatus for providing a removable shock-absorbing surface over the entire helmet outer surface, including the face cage hinge structure.

It is another object of the present invention to provide such an apparatus which permits coverage of helmet chin strap fasteners and thus of the area surrounding the helmet chin strap fasteners, without interfering with strap fastener engagement.

It is another object of the present invention to provide such an apparatus which does not substantially alter the appearance of the helmet when fitted onto the helmet.

It is still another object of the present invention to provide such an apparatus which does is installed without damage to the helmet structure.

It is a further object of the present invention to provide such an apparatus which is inexpensive enough for frequent cover apparatus replacement, such as during or between games.

It is finally an object of the present invention to provide such an apparatus which is fast and easy to install and remove without need of any tools, which maximizes safety and which is durable and reliable.

SUMMARY OF THE INVENTION

The present invention accomplishes the above-stated objectives, as well as others, as may be determined by a fair reading and interpretation of the entire specification.

A protective cover apparatus is provided for a helmet including a helmet shell with a helmet outer surface and a face exposing opening bordered by a helmet male snap fastener half protruding from the helmet outer surface, a helmet anchoring chin strap assembly having a strap extending from the strap assembly, the strap having a strap female snap fastener half which engages the helmet male snap fastener half bordering the face exposing opening, the apparatus including a shock-absorbing layer having a layer inner surface and a layer outer surface and which extends over the helmet outer surface and over the helmet male snap fastener half; a shock-absorbing layer attachment assembly including an attachment mechanism including a fastener interconnection structure passing through the layer at a location corresponding to and directly over the helmet male snap fastener half, the interconnection structure having a structure inside end to which is affixed a cover female snap fastener half for removably engaging the corresponding helmet male snap fastener half, and the interconnection structure having a structure outside end to which is affixed a cover male snap fastener half to engagingly receive the strap female snap fastener half so that the chin strap assembly may be attached with the cover in place over the helmet.

The shock-absorbing layer attachment assembly preferably additionally includes a hook and loop cover fastener pad affixed to the layer inner surface; and a hook and loop helmet fastener pad affixed to the helmet outer surface for removably engaging the cover fastener pad, for preventing forward and rearward movement of the layer relative to the helmet. Where the helmet includes a helmet outer surface and a hinged face protection cage for shielding the face exposing opening, the face protection cage including a protruding hinge structure secured to the helmet outer surface above the face exposing opening, the layer preferably extends over the entire helmet outer surface for full wearer protection including over the protruding hinge structure to prevent injury to other players.

The interconnection structure is preferably a stem, and the cover male and female snap fastener halves are preferably wider than the diameter of the stem and thus together with the stem define a rivet configuration, for preventing the attachment mechanism from sliding out of either the inner or outer surface of the layer.

A protective cover apparatus is also provided for a helmet including a helmet shell with a helmet outer surface and a face exposing opening bordered on either side by a helmet female snap fastener half protruding from the helmet outer surface, a helmet anchoring chin strap assembly having a strap extending from the strap assembly the strap having a strap male snap fastener half which engages the helmet female snap fastener half bordering the face exposing opening, the apparatus including a shock-absorbing layer having a layer inner surface and a layer outer surface and which extends over the helmet outer surface and over the helmet female snap fastener half; a shock-absorbing layer attachment assembly including an attachment mechanism including a fastener interconnection structure passing through the layer at a location corresponding to and directly over the helmet female snap fastener half, the interconnection structure having a structure inside end to which is affixed a cover male snap fastener half for removably engaging the corresponding the helmet female snap fastener half, and the interconnection structure having a structure outside end to which is affixed a cover female snap fastener half to engagingly receive the strap male snap fastener half so that the chin strap assembly may be attached with the cover in place over the helmet.

A protective helmet and cover apparatus is provided, including a helmet including a helmet shell with a helmet outer surface and a face exposing opening bordered by a helmet fastener, a helmet anchoring chin strap assembly having a strap extending from the strap assembly, the strap having a strap fastener which engages the helmet fastener bordering the face exposing opening; a shock-absorbing layer having a layer inner surface and a layer outer surface and which extends over at least part of the helmet outer surface and over the helmet fastener; a shock-absorbing layer attachment assembly including an attachment mechanism including a fastener interconnection structure passing through the layer at a location corresponding to and directly over the helmet fastener, the interconnection structure having a structure inside end to which is affixed a cover first fastener for removably engaging the corresponding helmet fastener, and the interconnection structure having a structure outside end to which is affixed a cover second fastener to engagingly receive the strap fastener so that the chin strap assembly may be attached with the cover in place over the helmet.

A protective helmet and cover apparatus is also provided, including a helmet including a helmet shell with a helmet outer surface and a face exposing opening bordered by a helmet fastener, a helmet anchoring chin strap assembly having a strap extending from the strap assembly, the strap having a strap fastener which engages the helmet fastener bordering the face exposing opening; a shock-absorbing layer having a layer inner surface and a layer outer surface and which extends over at least part of the helmet outer surface and over the helmet fastener; a shock-absorbing layer attachment assembly including an attachment mechanism including a fastener structure secured to the layer at a location corresponding to and directly over the helmet fastener, the fastener structure having a inside anchoring mechanism to which is affixed a cover first fastener for removably engaging the corresponding helmet fastener, and the fastener structure having an outside anchoring mechanism, separate from the inside anchoring mechanism, to which is affixed a cover second fastener to engagingly receive the strap fastener so that the chin strap assembly may be attached with the cover in place over the helmet.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
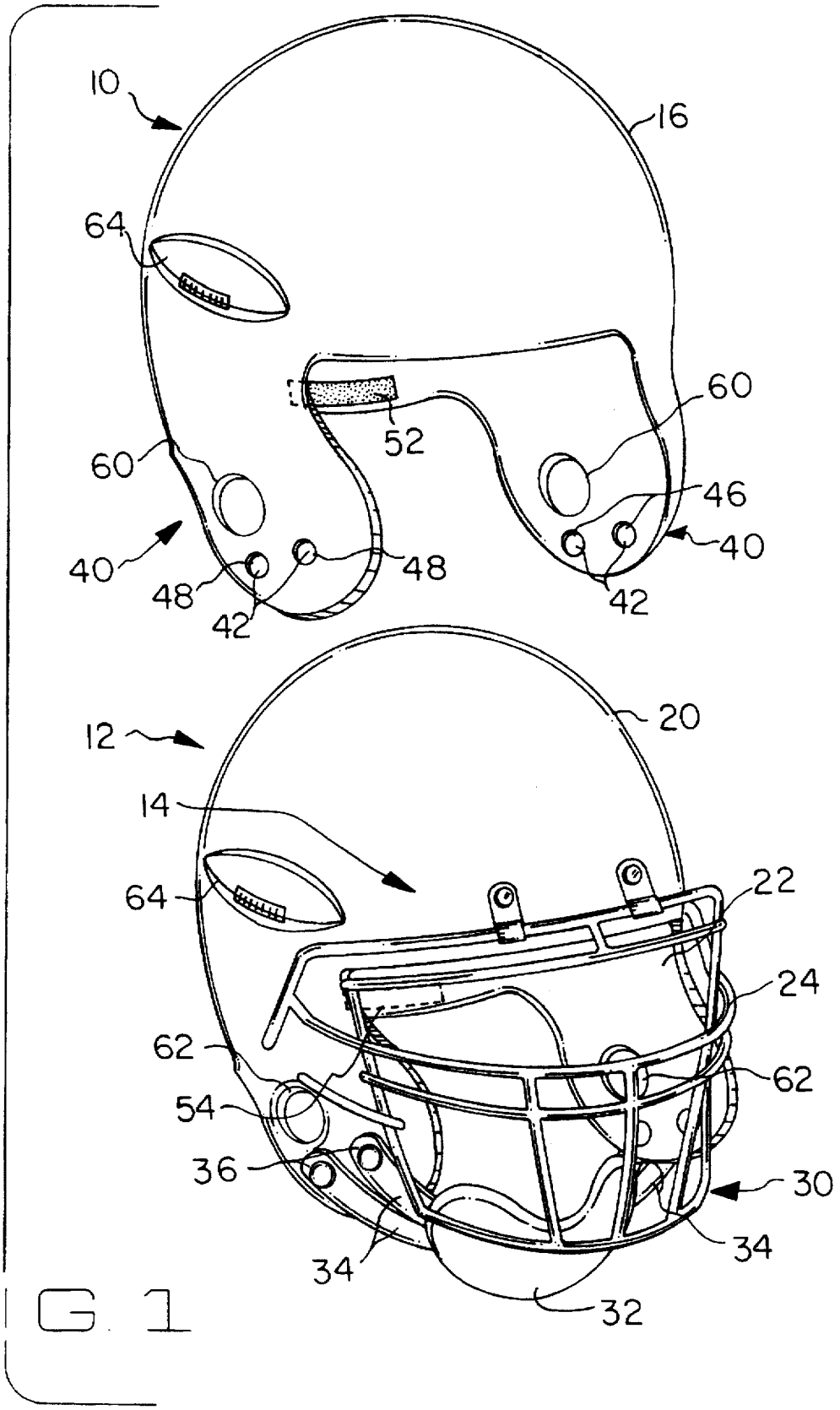
FIG. 1 is a perspective view of a conventional football helmet with the inventive helmet cover positioned above the helmet.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

First Preferred Embodiment

Referring to FIGS. 1–4, a helmet cover 10 is disclosed including a form-fitting, shock-absorbing layer 16 which is removably and replaceably secured with an attachment assembly 40 over the outer surface of a helmet 12, such as for football.

A conventional football helmet 12 includes helmet shell 20 having a face exposing opening 22 shielded by a hinged face protection cage 24 and bordered on either side by helmet male snap fastener halves 26. A helmet anchoring chin strap assembly 30 is provided including a plastic cup 32 which fits snugly over the wearer chin and two straps 34 extending from each side of the cup 32. Each strap 34 has a strap female snap fastener half 36 at its helmet engaging end which engages one of the helmet male snap fastener halves 26 bordering face exposing opening 22.

Cover 10 includes a shock form fitting absorbing layer 16 which preferably extends over the entire helmet 12 outer surface for full protection, and specifically over helmet male snap fastener halves 26. Cover 10 preferably extends over the protruding hinge structure 14 for the face cage 24, which could cause serious injury to another player if left uncovered.

The inventive cover attachment assembly 40 comprises four attachment mechanisms 42, each including a fastener stem 44 passing through the layer 16 at each location corresponding to and directly over a helmet male snap fastener half 26. To each stem 44 inside end is affixed a cover female snap fastener half 46 for removably engaging the corresponding helmet male snap fastener half 26. To each stem 44 outside end is affixed a cover male snap fastener half 48 to engagingly receive one of the strap female snap fastener halves 36 so that chin strap assembly 30 may be attached with the layer 16 in place over helmet 12. See FIG. 3. The cover male and female snap fastener halves 48 and 46 respectively are wider than the stem 44 diameter, and thus together with stem 44 effectively define an attachment mechanism 42 having a rivet configuration. The snap fasteners at each stem 44 end prevents each attachment mechanism 42 from sliding out of the helmet cover shock-absorbing layer 16.

To prevent forward and rearward movement of layer 16 relative to the helmet 12, a hook and loop cover fastener pad 52 is affixed to the rear cover inner surface. See FIG. 1. Cover fastener pad 52 engages a hook and loop helmet fastener pad 54 affixed to the rear helmet outer surface.

The layer 16 material is preferably a synthetic foam rubber. The preferred thickness is about three quarters of an inch, or within a range of one half to one inch thickness, although many other thicknesses are contemplated and depend largely on the density and resilience of the layer 16 material used. The outside surface of cover 10 preferably displays a team logo 64 and color scheme so that a covered helmet 12 has an appearance substantially identical to a non-covered helmet 12.

Figure 2:
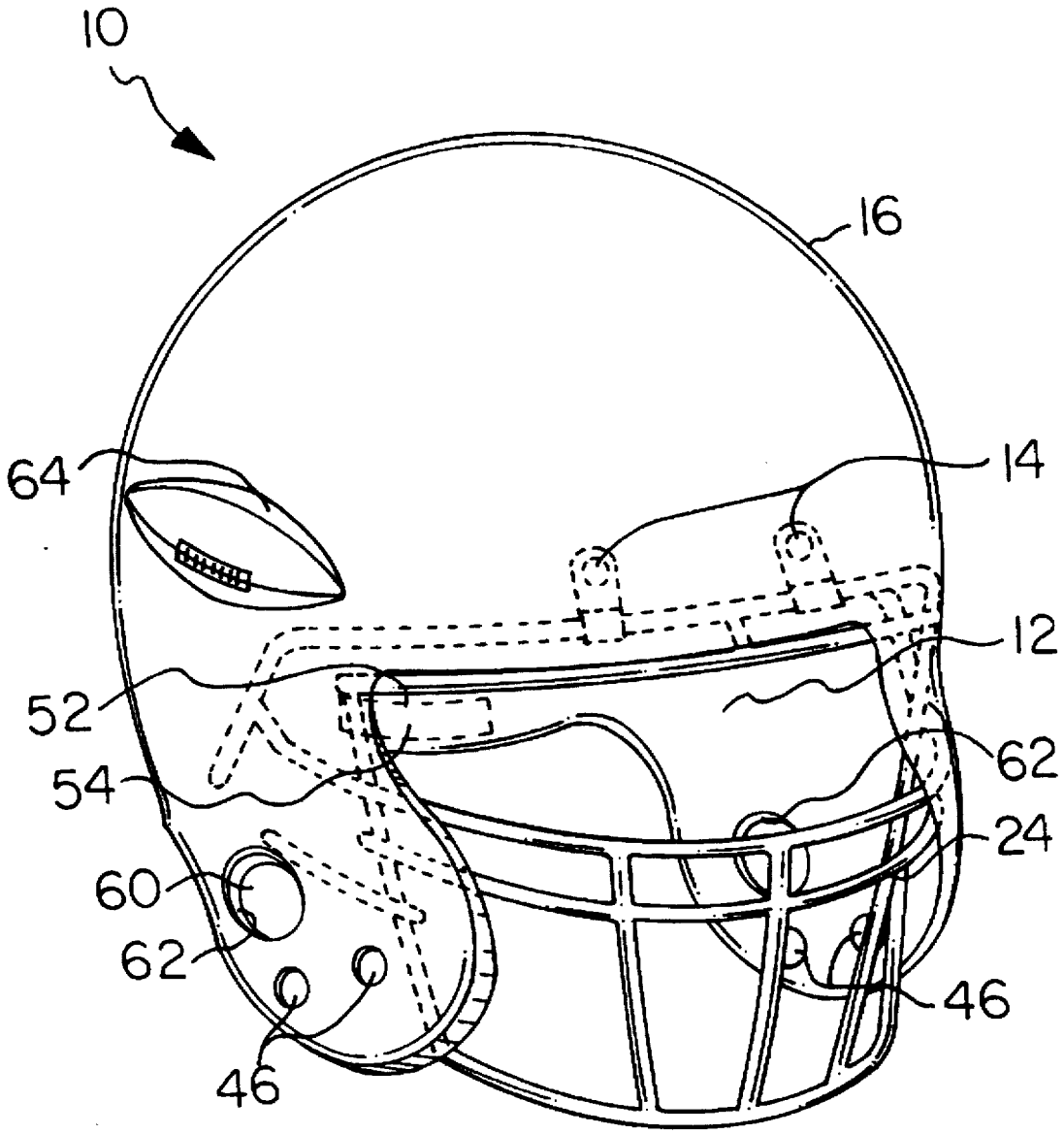
FIG. 2 is a perspective view as in FIG. 1, with the cover fitted into place onto the helmet.
Figure 3:
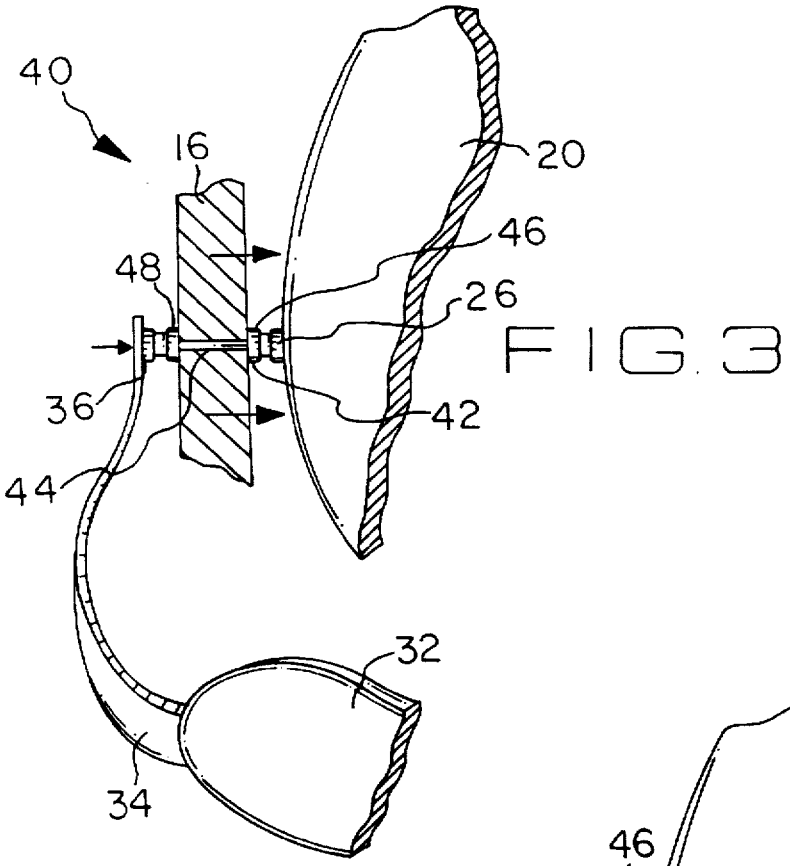
FIG. 3 is a broken away view of the portion of the helmet having the chin strap assembly fastener and showing in cross-section a portion of the helmet cover shock-absorbing layer. The first embodiment of the inventive attachment assembly is illustrated, including the opposing snap fastener halves joined by the stem interconnection structure.
Figure 4:
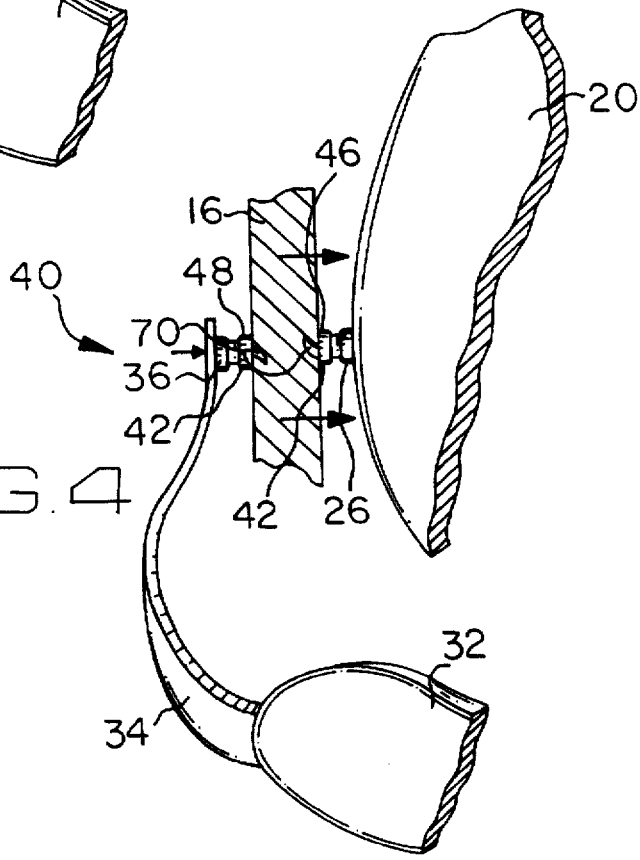
FIG. 4 is a view as in FIG. 3 showing the second embodiment of the attachment assembly, having separate fastener half anchoring mechanisms rather than the interconnection structure.

It is contemplated that all male fastener halves on helmet 12 and cover 10 may be replaced with female fastener halves, and all female fastener halves on helmet 12 and cover 10 may be replaced with male fastener halves, for an equivalent structure and function. Other types of mutually compatible fasteners may also be used on helmet 12 and cover 10. Cover ear holes 60 are optionally provided to register with helmet ear openings 62, as shown in FIGS. 1 and 2. Cover ear holes 60 may be omitted to muffle crowd noise.

Second Preferred Embodiment

As a second embodiment, it is contemplated that the interconnecting stem 44 be omitted and that cover female and male snap fastener halves 46 and 48, respectively, be held in place with separate anchoring means 70. These anchoring means 70 preferably take the form of a very strong glue or an anchoring element extending into cover layer 16. See FIG. 4.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A protective cover apparatus for a helmet comprising a helmet shell with a helmet outer surface and a face exposing opening bordered by a helmet male snap fastener half protruding from the helmet outer surface, a helmet anchoring chin strap assembly having a strap extending from said strap assembly, said strap having a strap female snap fastener half which engages said helmet male snap fastener half bordering said face exposing opening, comprising:

a shock-absorbing layer having a layer inner surface and a layer outer surface and which extends over the helmet outer surface and over said helmet male snap fastener half;

a shock-absorbing layer attachment assembly comprising an attachment mechanism including a fastener interconnection structure passing through said layer at a location corresponding to and directly over said helmet male snap fastener half, said interconnection structure having a structure inside end to which is affixed a cover female snap fastener half for removably engaging the corresponding said helmet male snap fastener half, and said interconnection structure having a structure outside end to which is affixed a cover male snap fastener half to engagingly receive said strap female snap fastener half such that said chin strap assembly may be attached with said cover in place over the helmet.

2. The apparatus of claim 1, wherein said shock-absorbing layer attachment assembly additionally comprises:

a hook and loop cover fastener pad affixed to said layer inner surface;

a hook and loop helmet fastener pad affixed to said helmet outer surface for removably engaging said cover fastener pad, for preventing forward and rearward movement of said layer relative to said helmet.

3. The apparatus of claim 1, wherein said helmet comprises a helmet outer surface and a hinged face protection cage for shielding said face exposing opening, said face protection cage including a protruding hinge structure secured to the helmet outer surface above said face exposing opening, said layer extending over the entire helmet outer surface for full wearer protection including over the protruding hinge structure to prevent injury to other players.

4. The apparatus of claim 1, wherein said interconnection structure is a stem, and wherein said cover male and female snap fastener halves are wider than the diameter of said stem and thus together with said stem define a rivet configuration, for preventing said attachment mechanism from sliding out of either the inner or outer surface of said layer.

5. A protective cover apparatus for a helmet comprising a helmet shell with a helmet outer surface and a face exposing opening bordered on either side by a helmet female snap fastener half protruding from the helmet outer surface, a helmet anchoring chin strap assembly having a strap extending from said strap assembly said strap having a strap male snap fastener half which engages said helmet female snap fastener half bordering said face exposing opening, comprising:

a shock-absorbing layer having a layer inner surface and a layer outer surface and which extends over the helmet outer surface and over said helmet female snap fastener half;

a shock-absorbing layer attachment assembly comprising an attachment mechanism including a fastener interconnection structure passing through said layer at a location corresponding to and directly over said helmet female snap fastener half, said interconnection structure having a structure inside end to which is affixed a cover male snap fastener half for removably engaging the corresponding said helmet female snap fastener half, and said interconnection structure having a structure outside end to which is affixed a cover female snap fastener half to engagingly receive said strap male snap fastener half such that said chin strap assembly may be attached with said cover in place over the helmet.

6. The apparatus of claim 5, wherein said shock-absorbing layer attachment assembly additionally comprises:

a hook and loop cover fastener pad affixed to said layer inner surface;

a hook and loop helmet fastener pad affixed to said helmet outer surface for removably engaging said cover fastener pad, for preventing forward and rearward movement of said layer relative to said helmet.

7. The apparatus of claim 5, wherein said helmet comprises a helmet outer surface and a hinged face protection cage for shielding said face exposing opening, said face protection cage including a protruding hinge structure secured to the helmet outer surface above said face exposing opening, said layer extending over the entire helmet outer surface for full wearer protection including over the protruding hinge structure to prevent injury to other players.

8. The apparatus of claim 5, wherein said interconnection structure is a stem, and wherein said cover female and male snap fastener halves are wider than the diameter of said stem and thus together with said stem define a rivet configuration, for preventing said attachment mechanism from sliding out of either the inner or outer surface of said layer.

9. A protective helmet and cover apparatus, comprising:

a helmet comprising a helmet shell with a helmet outer surface and a face exposing opening bordered by helmet fastener means, a helmet anchoring chin strap assembly having a strap extending from said strap assembly, said strap having a strap fastener means which engages said helmet fastener means bordering said face exposing opening;

a shock-absorbing layer having a layer inner surface and a layer outer surface and which extends over at least part of said helmet outer surface and over said helmet fastener means;

a shock-absorbing layer attachment assembly comprising an attachment mechanism including a fastener interconnection structure passing through said layer at a location corresponding to and directly over said helmet fastener means, said interconnection structure having a structure inside end to which is affixed a cover first fastener means for removably engaging the corresponding said helmet fastener means, and said interconnection structure having a structure outside end to which is affixed a cover second fastener means to engagingly receive said strap fastener means such that said chin strap assembly may be attached with said cover in place over the helmet.

10. The apparatus of claim 9, wherein said shock-absorbing layer attachment assembly additionally comprises:

a cover fastener element affixed to said layer inner surface;

a helmet fastener element affixed to said helmet outer surface for removably engaging said cover fastener element, for preventing forward and rearward movement of said layer relative to said helmet.

11. The apparatus of claim 9, wherein said helmet comprises a helmet outer surface and a hinged face protection cage for shielding said face exposing opening, said face protection cage including a protruding hinge structure secured to the helmet outer surface above said face exposing opening, said layer extending over the entire helmet outer surface for full wearer protection including over the protruding hinge structure to prevent injury to other players.

12. The apparatus of claim 9, wherein said interconnection structure is a stem, and wherein said cover first and second fastener means are wider than the diameter of said stem and thus together with said stem define a rivet configuration, for preventing said attachment mechanism from sliding out of either the inner or outer surface of said layer.

13. The apparatus of claim 11, wherein said helmet outer surface includes a team logo, and wherein said layer has a layer outer surface, additionally comprising a team identifying logo and on said layer outer surface substantially said team logo on said helmet outer surface.

14. The apparatus of claim 3, wherein said helmet outer surface includes a team logo, and wherein said layer has a layer outer surface, additionally comprising a team identifying logo and on said layer outer surface substantially said team logo on said helmet outer surface.

15. The apparatus of claim 7, wherein said helmet outer surface includes a team logo, and wherein said layer has a layer outer surface, additionally comprising a team identifying logo and on said layer outer surface substantially said team logo on said helmet outer surface.

16. A protective helmet and cover apparatus, comprising:

a helmet comprising a helmet shell with a helmet outer surface and a face exposing opening bordered by helmet fastener means, a helmet anchoring chin strap assembly having a strap extending from said strap assembly, said strap having a strap fastener means which engages said helmet fastener means bordering said face exposing opening;

a shock-absorbing layer having a layer inner surface and a layer outer surface and which extends over at least part of said helmet outer surface;

a shock-absorbing layer attachment assembly comprising an attachment mechanism including a fastener interconnection structure passing through a part of said helmet cover at a location corresponding to and directly over said helmet fastener means, said interconnection structure having a structure inside end to which is affixed a cover first fastener means for removably engaging the corresponding said helmet fastener means, and said interconnection structure having a structure outside end to which is affixed a cover second fastener means to engagingly receive said strap fastener means.

17. A protective helmet and cover apparatus, comprising:

a helmet comprising a helmet shell with a helmet outer surface and a face exposing opening bordered by helmet fastener means, a helmet anchoring chin strap assembly having a strap extending from said strap assembly, said strap having a strap fastener means which engages said helmet fastener means bordering said face exposing opening;

a shock-absorbing layer having a layer inner surface and a layer outer surface and which extends over at least part of said helmet outer surface and over said helmet fastener means;

a shock-absorbing layer attachment assembly comprising an attachment mechanism including a fastener structure secured to said layer at a location corresponding to and substantially directly over said helmet fastener means, said fastener structure having a inside anchoring means to which is affixed a cover first fastener means for removably engaging the corresponding said helmet fastener means, and said fastener structure having an outside anchoring means, separate from said inside anchoring means, to which is affixed a cover second fastener means to engagingly receive said strap fastener means such that said chin strap assembly may be attached with said cover in place over the helmet.

* * * * *